US005919060A

United States Patent [19]

Lee

[11] Patent Number: 5,919,060

[45] Date of Patent: Jul. 6, 1999

[54] SAFETY ELECTRIC SOCKET ADAPTER

[76] Inventor: Chiu-Shan Lee, No. 23, Lane 19, Chang-Chun Rd., Hsintien City, Taiwan

[21] Appl. No.: 09/110,476

[22] Filed: Jul. 7, 1998

[51] Int. Cl.[6] ..... H01R 29/00

[52] U.S. Cl. ..... 439/518; 439/177; 439/911

[58] Field of Search ..... 439/170, 177, 439/518, 894, 911, 957, 956; 363/142

[56] References Cited

U.S. PATENT DOCUMENTS 5,513,998 5/1996 Kim ..... 439/170

*Primary Examiner*—Shawn Riley
*Attorney, Agent, or Firm*—Rosenberg, Klein & Bilker

[57] ABSTRACT

A safety electric socket adapter includes a body having two longitudinal front sliding tracks and two longitudinal rear sliding tracks at two opposite sides, a first metal rack and two second metal racks respectively mounted in the body for receiving the grounding prong and metal blades of one of a set of electric plugs, a face panel and a back board respectively detachably fastened to front and rear sides of the body, the face panel and the back board each having two longitudinal side flanges respectively inserted into the front sliding tracks and rear sliding tracks of the body, the face panel having a grounding plug hole and two power plug holes for receiving the grounding prong and metal blades of one of a set of electric plugs of different specifications and spring-supported gate means forced by respective spring means to automatically close the power plug holes, a first metal plate and two second metal plates respectively mounted in the body and connected to the first metal rack and the second metal rack, a spring retainer mounted in the body to secure the back board to the body, the back board comprising a grounding prong and two power contact metal blades for connection to an electric plug, a raised retaining portion for engagement with the spring retainer, and a press rod controlled to disengage the raised retaining portion from the spring retainer.

6 Claims, 10 Drawing Sheets

SAFETY ELECTRIC SOCKET ADAPTER

BACKGROUND OF THE INVENTION

The present invention relates to an electric socket adapter for electrically connecting an electric plug to an electric socket, and more particularly to a safety electric socket adapter which can be alternatively attached with any of a variety of face panels and any of a variety of back boards to fit different electric plugs and different electric sockets.

SUMMARY OF THE INVENTION

It is one object of the present invention to provide a safety electric socket adapter which is safe in use. It is another object of the present invention to provide a safety electric socket adapter which can be alternatively attached with any of a variety of face panels and any of a variety of back boards to fit different electric plugs and different electric sockets. It is still another object of the present invention to provide a safety electric socket adapter which can be used in an extension cable. According to one aspect of the present invention, the safety electric socket adapter comprises a body having two longitudinal front sliding tracks and two longitudinal rear sliding tracks at two opposite sides, a first metal rack and two second metal racks respectively mounted in the body for receiving the grounding prong and metal blades of one of a set of electric plugs, a face panel and a back board respectively detachably fastened to front and rear sides of the body, the face panel and the back board each having two longitudinal side flanges respectively inserted into the front sliding tracks and rear sliding tracks of the body, the face panel having a grounding plug hole and two power plug holes for receiving the grounding prong and metal blades of one of a set of electric plugs of different specifications and spring-supported gate means forced by respective spring means to automatically close the power plug holes, a first metal plate and two second metal plates respectively mounted in the body and connected to the first metal rack and the second metal rack, a spring retainer mounted in the body to secure the back board to the body, the back board comprising a grounding prong and two power contact metal blades for connection to an electric plug, a raised retaining portion for engagement with the spring retainer, and a press rod controlled to disengage the raised retaining portion from the spring retainer. According to another aspect of the present invention, the face panel comprises spring-supported gate means forced by respective spring means to automatically close the power plug holes upon removable of the electric plug. According to still another aspect of the present invention, the back board has electrically insulative shields raised from the back side wall around the rear ends of the power contact metal blades to protect the power contact metal blades, the electrically insulative shields defining a respective downwardly extended receiving hole for receiving the second metal plates, enabling the power contact metal blades of the back board to be forced into contact with the second metal plates when the back board is coupled to the body.

BRIEF DESCRIPTION OF THE DRAWINGS

FIG. 1-A is another exploded view of the safety electric socket adapter shown in FIG. 1.

Figures from 1B through 1P show different arrangement of the metal racks with the face panel to fit different electric plugs.

Figure 1:
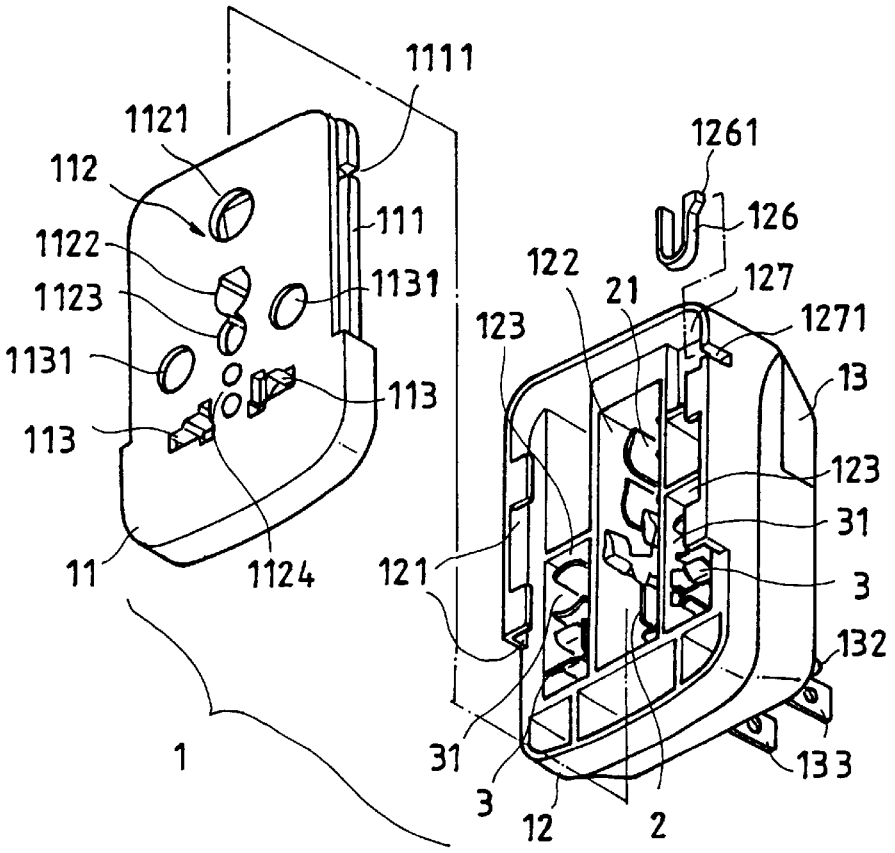
FIG. 1 is an exploded view of a safety electric socket adapter according to one embodiment of the present invention.
Figure 1A:
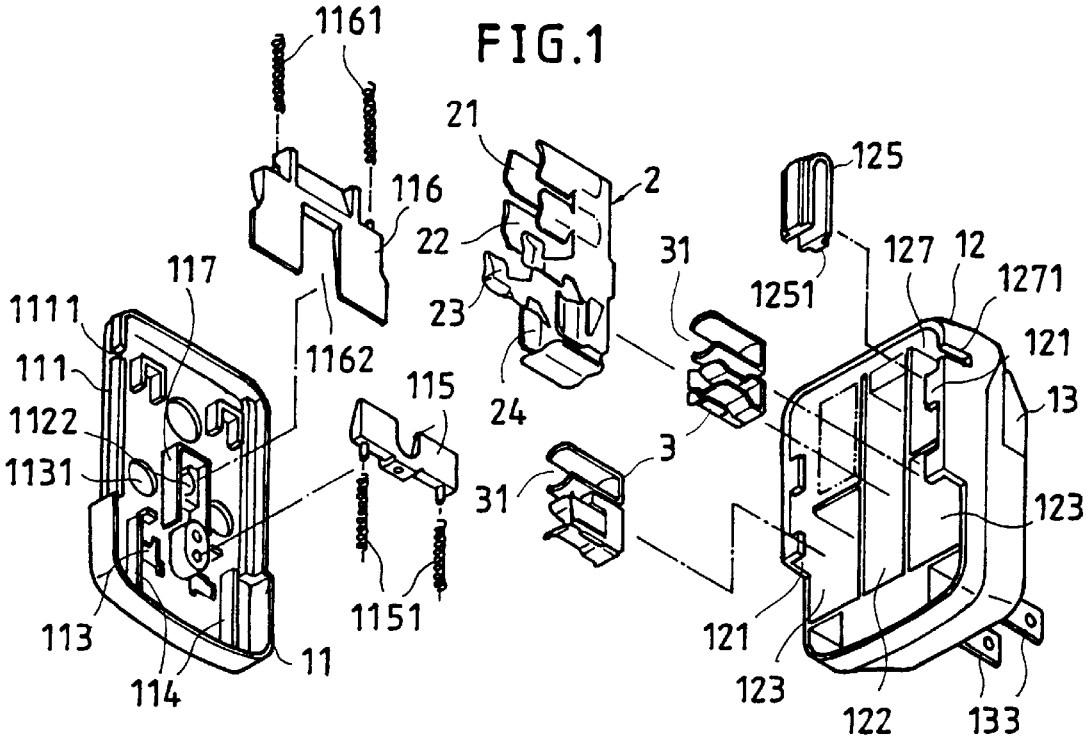
Figure 1B:
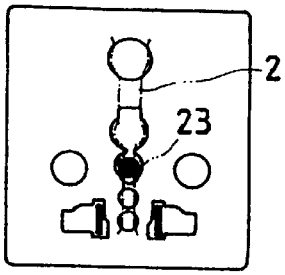
Figure 1G:
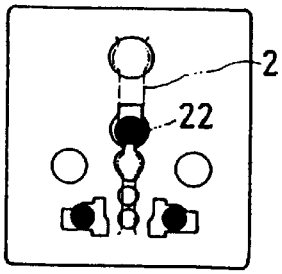
Figure 1L:
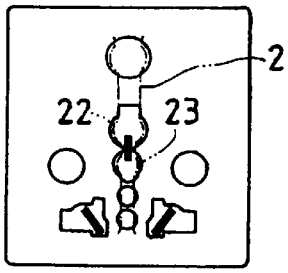
Figure 1C:
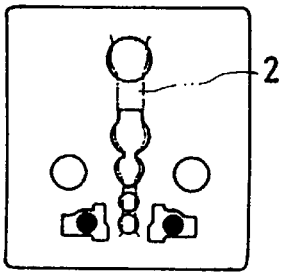
Figure 1H:
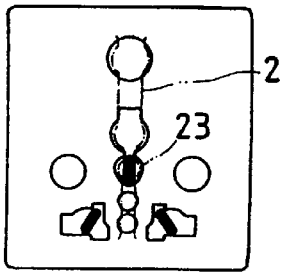
Figure 1M:
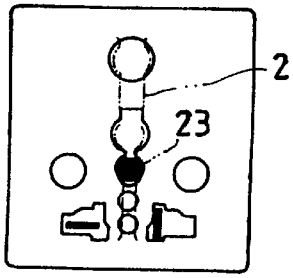
Figure 1D:
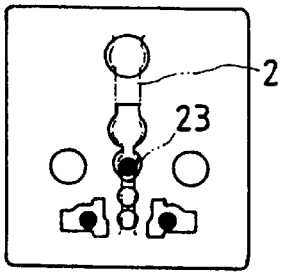
Figure 1I:
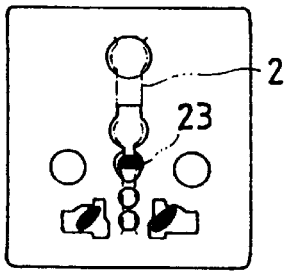
Figure 1N:
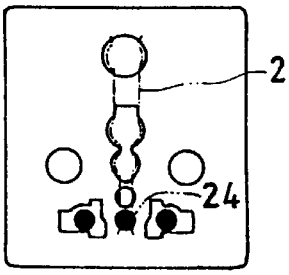
Figure 1E:
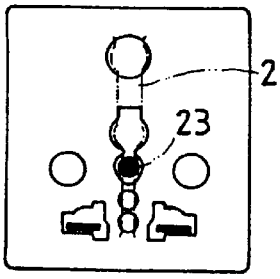
Figure 1J:
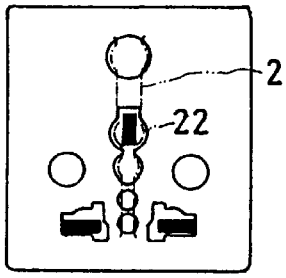
Figure 1O:
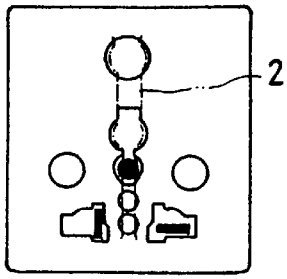
Figure 1F:
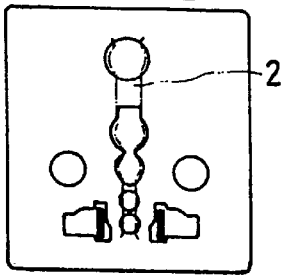
Figure 1K:
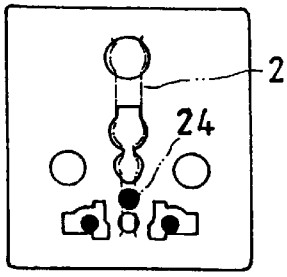
Figure 1P:
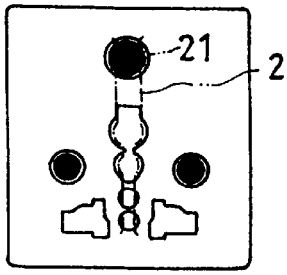
Figure 4A:
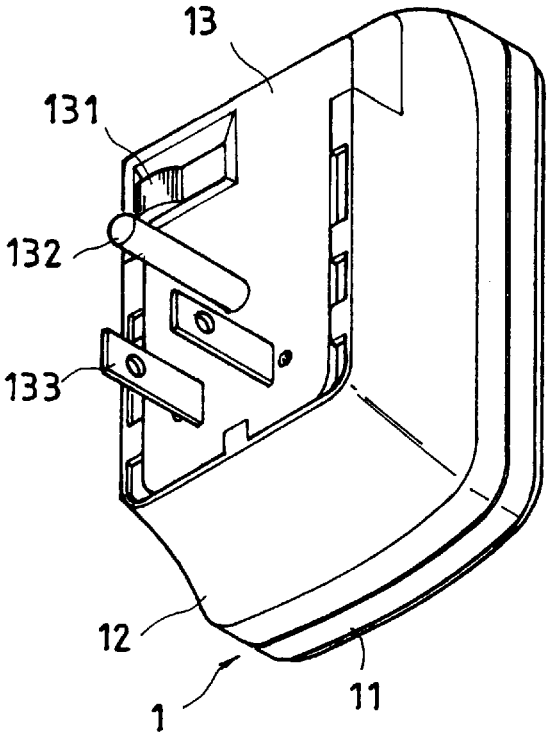
Figure 2:
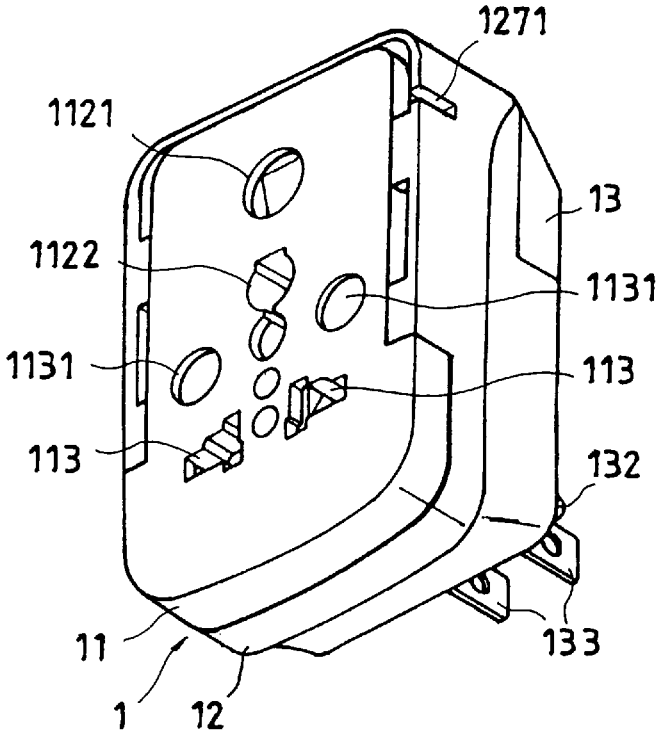

FIG. 2 is a perspective assembly view of the safety electric socket adapter shown in FIG. 1.

Figure 3:
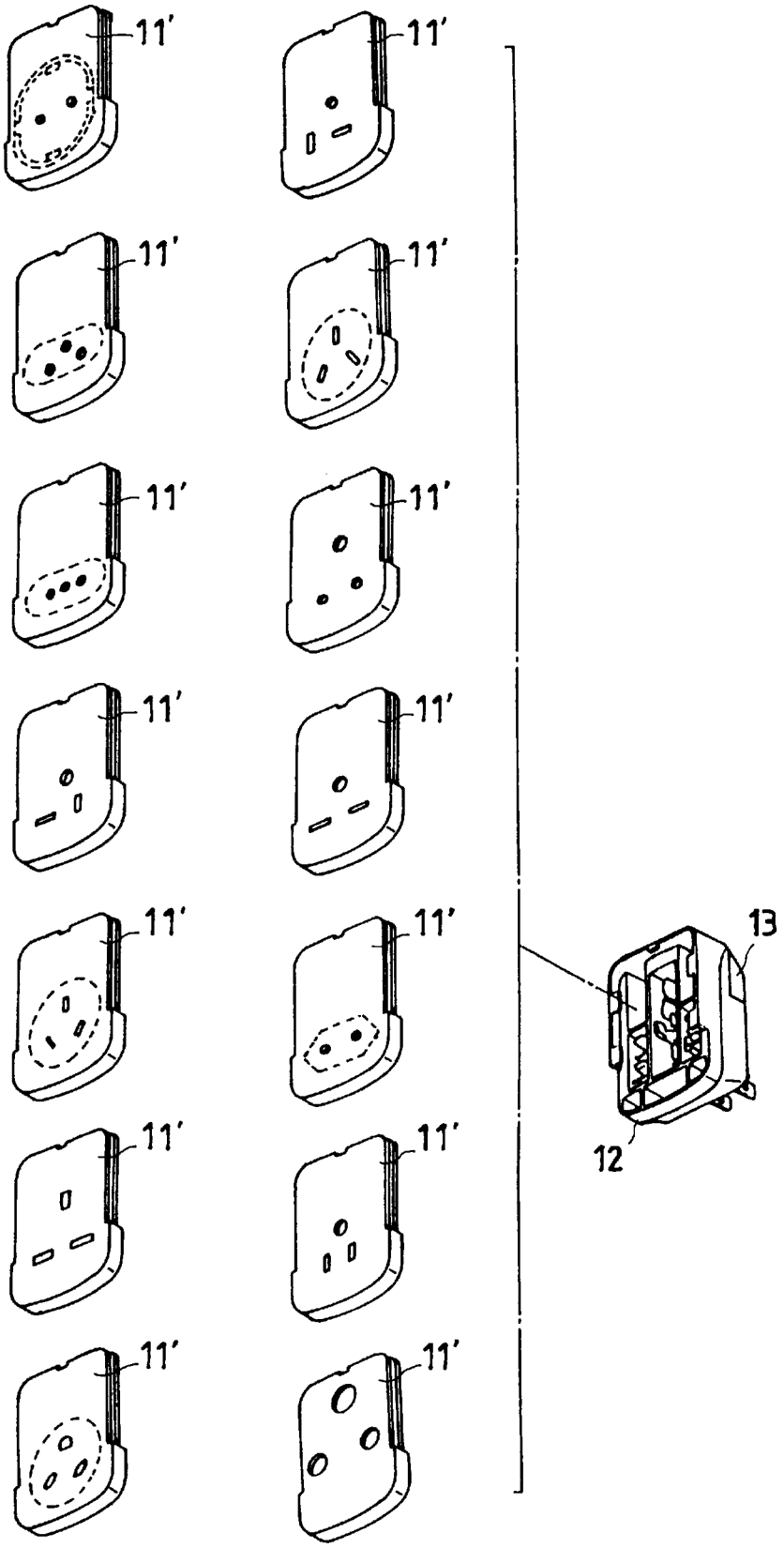

FIG. 3 shows a set of different forms of face panel for use with the assembly of the body and the back board shown in FIG. 1.

Figure 4D:
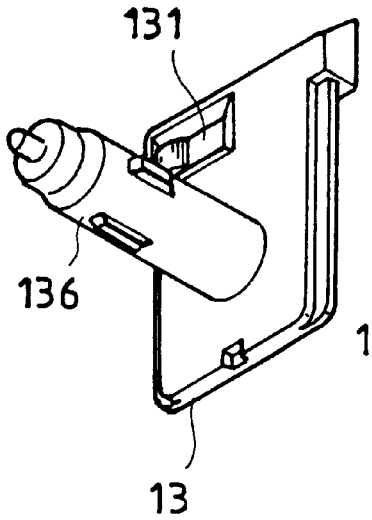
Figure 4C:
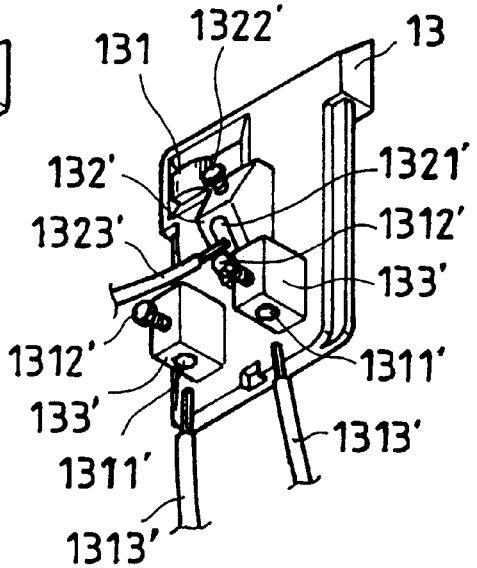
Figure 4:
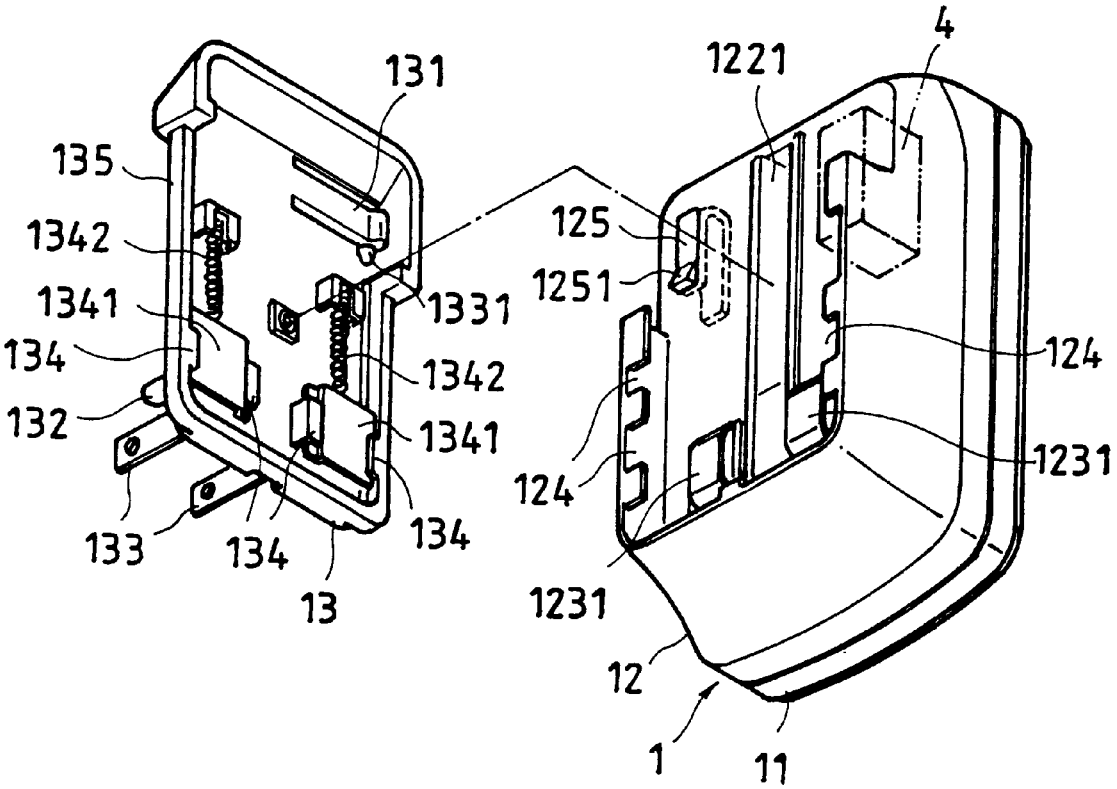
Figure 4B:
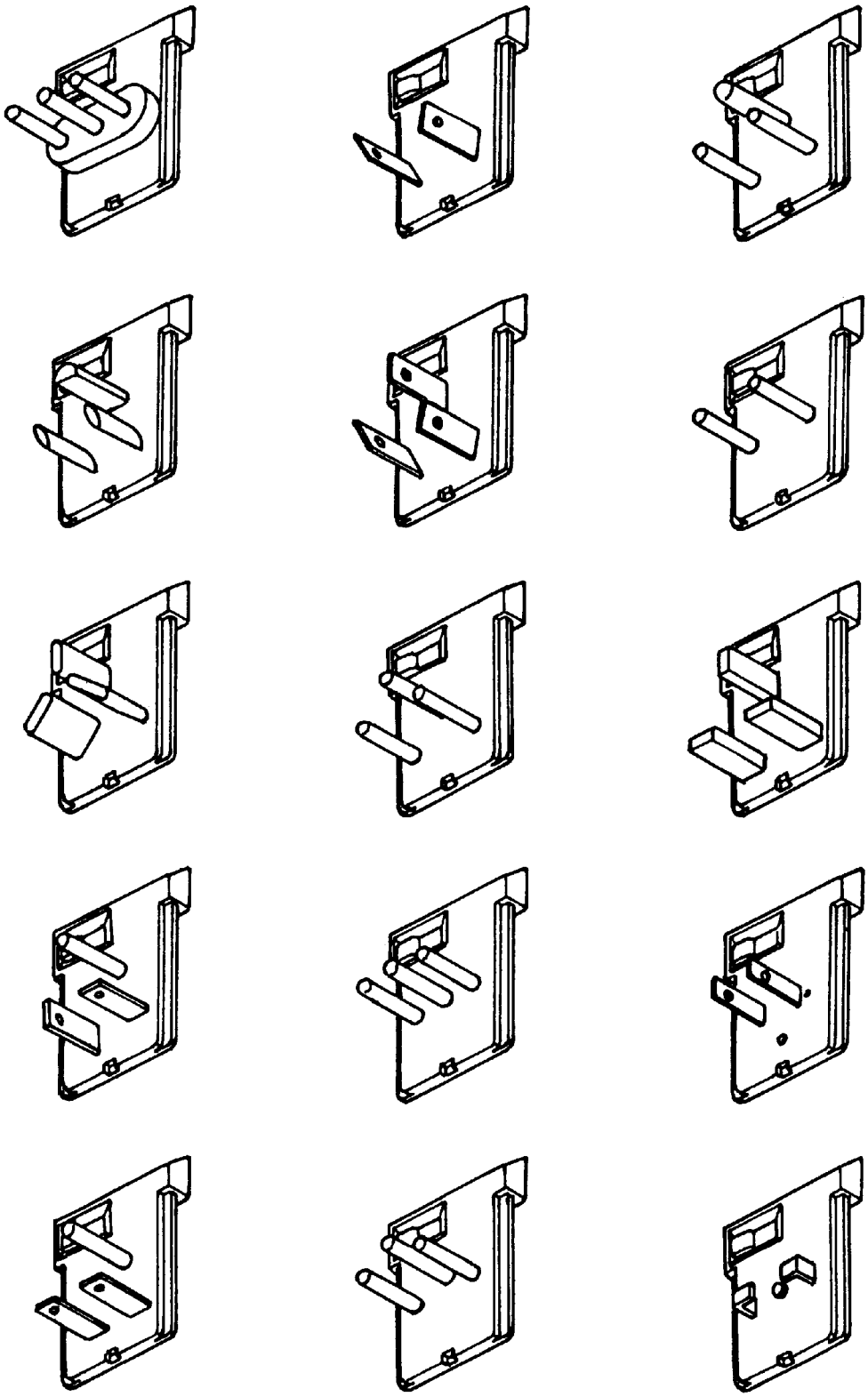
Figure 4E:
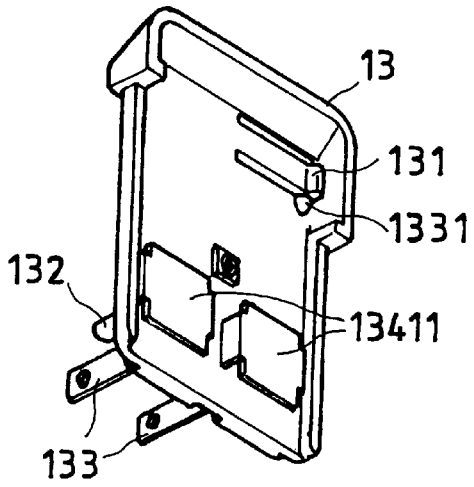
Figure 4F:
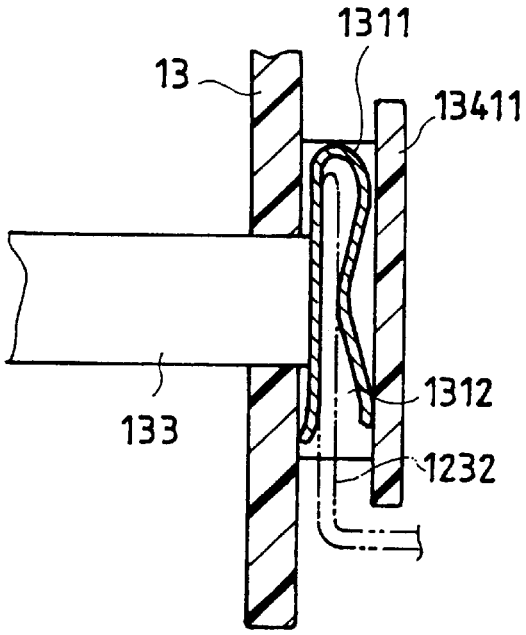
Figure 4G:
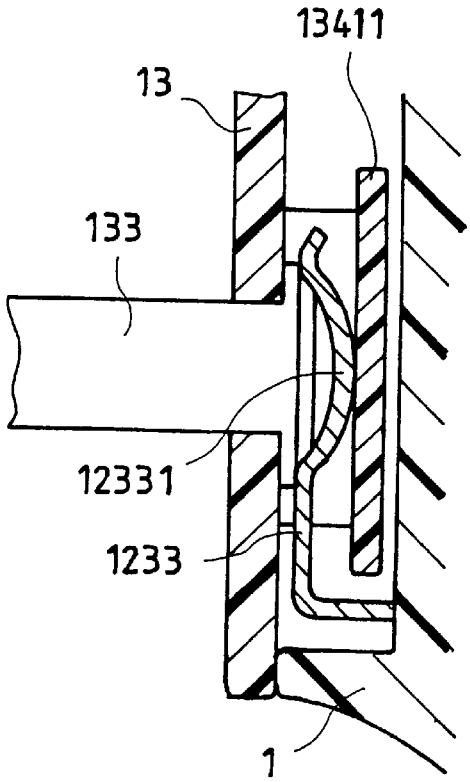

FIG. 4 shows the back board assembled, the body and the face panel assembled according to the present invention.

FIG. 4-A is a rear side view of FIG. 2

FIG. 4-B shows a set of different forms of back board according to the present invention.

FIG. 4-C is a perspective view of still another alternate form of the back board according to the present invention.

FIG. 4-D is a perspective view of still another alternative form of the back board according to the present invention.

FIG. 4-E is a perspective view of still another alternate form of the back board according to the present invention.

FIG. 4-F is a sectional view of a part of one embodiment of the present invention, showing the power contact metal plate connected to the metal terminal in the receiving hole within the electrically insulative shield.

FIG. 4-G is a sectional view of a part of another embodiment of the present invention, showing the convex portion of the power contact metal plate retained in contact with the rear end of the power metal contact blade.

Figure 5:
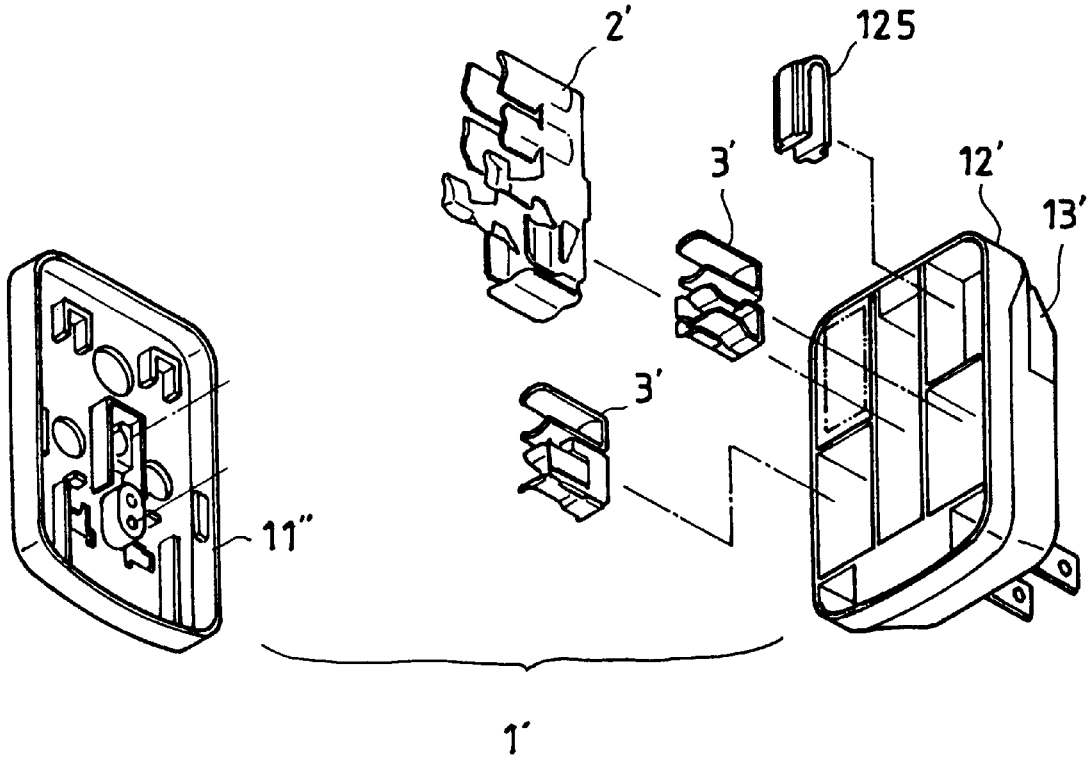
Figure 5A:
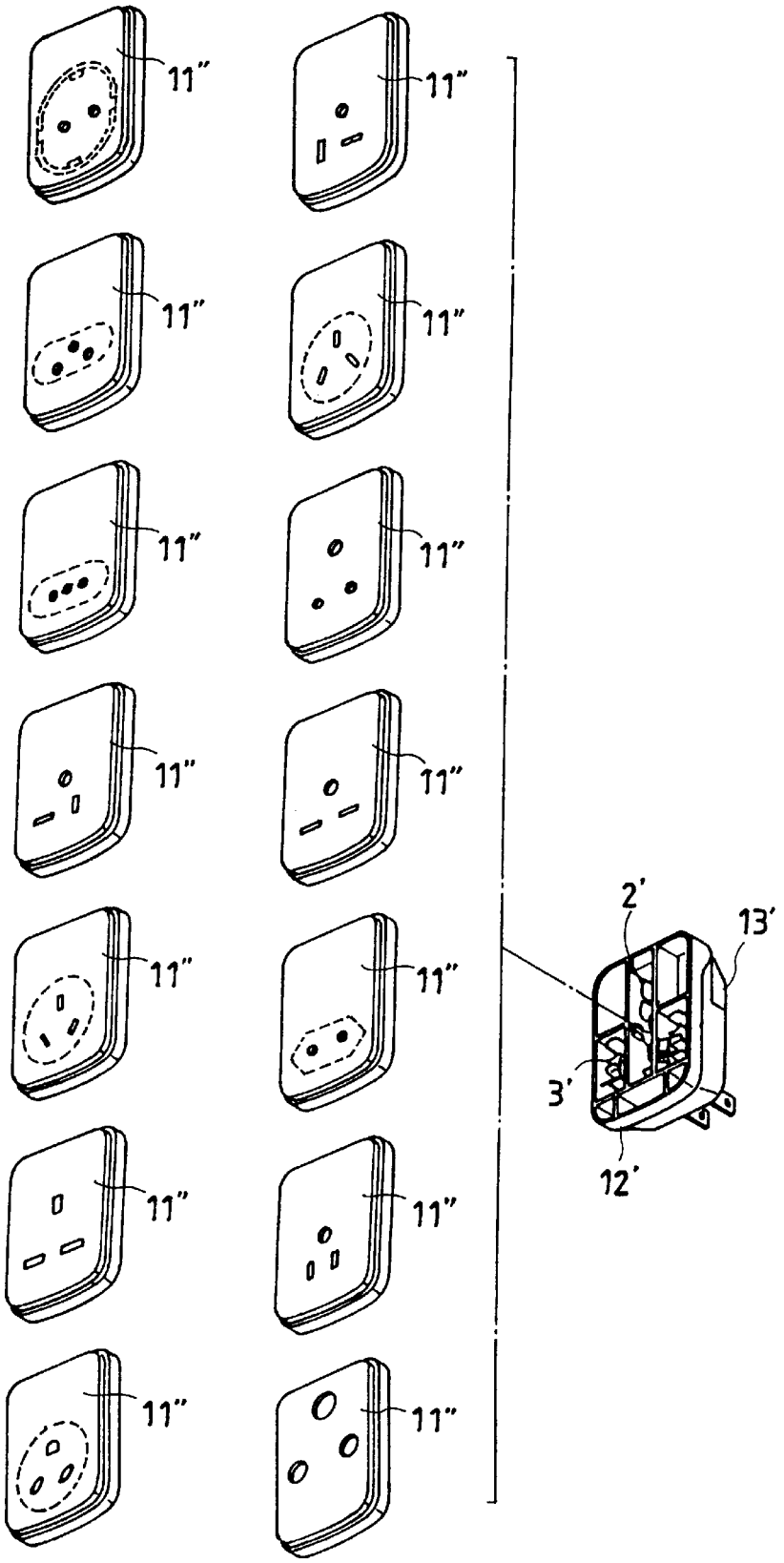

FIG. 5 is an exploded view of still another alternate form of the present invention.

FIG. 5-A shows a set of different forms of face panel for use with the assembly of the body and the back board shown in FIG. 5.

Figure 6:
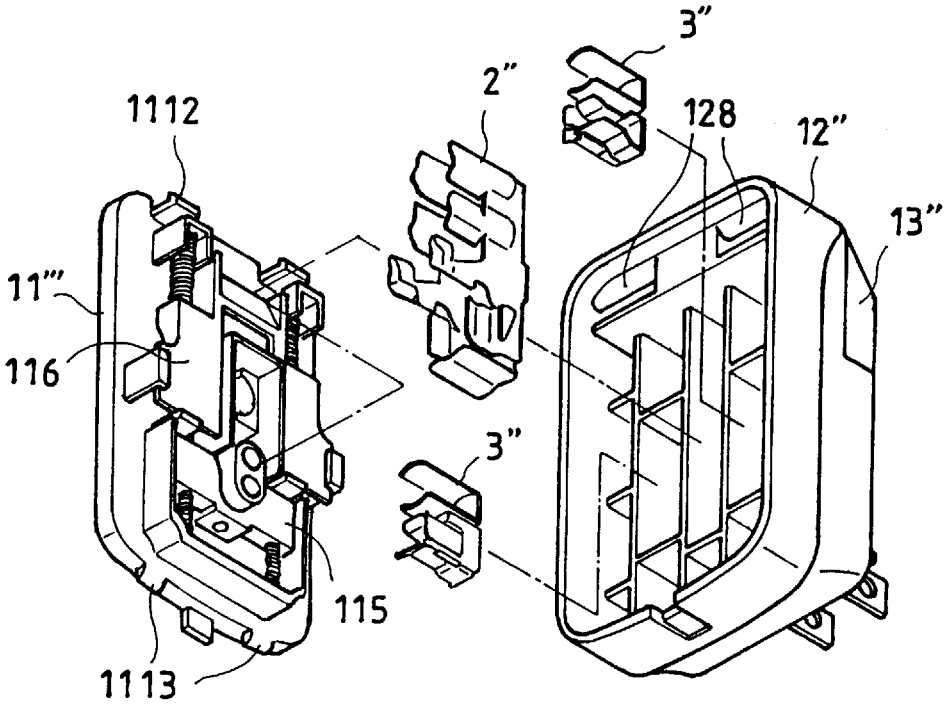
Figure 6A:
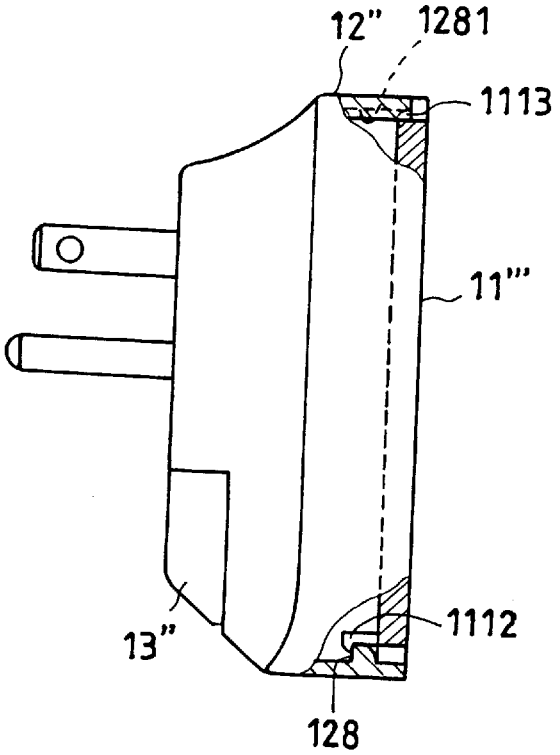

FIG. 6 is an exploded view of still another alternate form of the present invention.

FIG. 6-A is an assembly view in section of the embodiment shown in FIG. 6.

DETAILED DESCRIPTION OF THE PREFERRED EMBODIMENT

Referring to FIGS. 1, 1-A, 2 and 3, a safety electric socket adapter 1 comprises of a body 12, a face panel 11 covered on the front side of the body 12, and a back board 13 covered on the back side of the body 12. The body 12 comprises an elongated middle chamber 122, two side chambers 123 at two opposite sides of the elongated middle chamber 122, a first metal rack 2 mounted in the elongated middle chamber 122, two second metal racks 3 respectively mounted in the side chambers 123, two sliding tracks 121 bilaterally provided at the opened front side thereof into which opposite side flanges 111 of the face panel 11 are inserted, a receiving hole 127 adjacent to one side chamber 123, a side notch 1271 near one end in communication with the receiving hole 127, and a U-shaped spring retainer 126 mounted in the receiving hole 127, the U-shaped spring retainer 126 having a hooked portion 1261 at one end, which is forced into engagement with a retaining notch 1111 on one side flange 111 of the face panel 11 to secure the face panel 11 to the body 12 when the face panel 11 is inserted into the tracks 121. The back board 13 is fastened to the opened rear side of the body 12. The back board 13 holds a grounding prong 132 and two metal blades 133 that are respectively connected to the first metal rack 2 and second metal racks 3. When a tool for example a screwdriver is inserted through the side notch 1271 into the receiving hole 127 and pressed on the hooked portion 1261 of the spring retainer 126 to disengage the hooked portion 1261 from the retaining notch 1111, the face panel 11 can then be conveniently removed from the body 12. The face panel 11 comprises two longitudinally extended parallel guide plates 114 bilaterally disposed at the back side thereof near the bottom, two power plug holes 113 spaced between the guide plates 114, a first safety gate 115 moved between the guide plates 114, first spring elements 1151 fastened to the back side at the bottom and imparting an upward pressure to the first gate 115, causing the first gate 115 to close the power plug holes 113, a middle guide frame 117 at the back side on the middle, a power plug hole 1121 and a grounding plug hole 1122 for an electric plug of South Africa's specification, a second safety gate 116 moved relative to the guide frame 117, and second spring elements 1161 fastened to the back side at the top and imparting a downward pressure to the second gate 116, causing the second gate 116 to close the plug hole 1121, the second safety gate 116 having a bottom notch opening 1162 on the middle corresponding to the middle guide frame 117. When the metal blades of an electric plug is inserted into the power plug holes 113, the first gate 115 is automatically forced downwards, enabling the metal blades of the power plug to be inserted into position. When an electric plug is inserted into the plug holes 1121;1122, the second safety gate 116 is automatically forced upwards, enabling the electric plug of South Africa specification to be inserted into position.

Referring to FIG. 1-A, and Figures from 1-A through 1-P, the first metal rack 2 comprises a first clamping mouth 21 for receiving the grounding prong of an electric plug of South Africa specification, a second clamping mouth 22, a third clamping mouth 23 and a fourth clamping mouth 24 for receiving the grounding prongs of electric plugs of different specifications respectively. FIG. 1-B Shows electric socket adapter arranged to receive the grounding prong of an electric plug of US specification by means of the third clamping mouth 23 of the first metal rack 2. FIG. 1-C shows the electric socket adapter arranged to receive the grounding prong of an electric plug of Germany or France specification by means of the third clamping mouth 23 of the first metal rack 2. FIG. 1-D shows the electric socket adapter arranged to receive the grounding prong of an electric plug of Middle East specification by means of the third clamping mouth 23 of the first metal rack 2. FIG. 1-E shows the electric socket adapter arranged to receive the grounding prong of a 220 V electric plug of Taiwan or US specification by means of the third clamping mouth 23 of the first metal rack 2. FIG. 1-F shows the electric socket adapter arranged to receive the grounding prong of an electric plug of Taiwan, US or Japan specification by means of the second clamping mouth 22 of the first metal rack 2. FIG. 1-G shows the electric socket adapter arranged to receive the grounding prong of a means electric plug of South Africa specification by means of the second clamping mouth 22 of the first metal rack 2. FIG. 1-H shows the electric socket adapter arranged to receive the grounding prong of an electric plug of Israel specification by means of the third clamping mouth 23 of tile first metal rack 2. FIG. 1-I shows the electric socket adapter arranged to receive the grounding prong of an electric plug of Denmark specification by means of the third clamping mouth 23 of the first metal rack 2. FIG. 1-J shows the electric socket adapter arranged to receive the grounding prong of an electric plug of British specification by means of the second clamping mouth 22 of the first metal rack 2. FIG. 1-K shows the electric socket adapter arranged to receive the grounding prong of an electric plug of Swiss specification by means of the fourth clamping mouth 24 of the first metal rack 2. FIG. 1-L shows the electric socket adapter arranged to receive grounding prongs of an electric plug of Australia or New Zealand specification by means of the second clamping mouth 22 and third clamping mouth 23 of the first metal rack 2. FIG. 1-M shows the electric socket adapter arranged to receive the grounding prong of an electric plug of Japan, Taiwan or US specification by means of the third clamping mouth 23 of the first metal rack 2. FIG. 1-N shows the electric socket adapter arranged to receive the grounding prong of an electric plug of Italy specification by means of the fourth clamping mouth 24. FIG. 1-O shows the electric socket adapter arranged to receive a 110 V electric plug of Japan, Taiwan or US specification. FIG. 1-P shows the electric socket adapter arranged to receive the grounding prong of a big electric plug of South Africa specification by means of the first clamping mouth 21. As indicated above, the first metal rack 2 of the electric socket adapter can receive the grounding prong of any of a variety of electric plugs, and the voltage level of the electric socket adapter can be arranged within about 125 V~250 V.

Referring to FIGS. 4, 4-A, 4-B, 4-cand 4-D, different back boards 13 may be alternatively arranged with the body 12 to form different forms of electric socket adapter 1 to fit different specifications.

Referring to FIGS. 4 and 4-A, the body 12 comprises a grounding metal plate 1121 and two power contact metal plates 1231 mounted at the back side and respectively disposed in contact with the first metal rack 2 and the second metal racks 3, and two sliding tracks 124 bilaterally disposed at the back side. The back board 13 is inserted into the sliding tracks 124, and coupled to the body 12. The back board 13 comprises two longitudinal side flanges 135, a grounding prong 132, and two metal blades 133. When the longitudinal side flanges 135 are inserted into the sliding tracks 124, the grounding prong 132 and the metal blades 133 are respectively forced into contact with the grounding metal plate 1121 and the power contact metal plates 1231. The back board 13 further comprises two pairs of parallel sliding rails 134 at the back side, two sliding boards 1341 moved in the sliding rails 134, and two spring elements 1342 fixedly mounted at the back side and respectively connected to the sliding boards 1341. The spring elements 1342 impart a downward pressure to the sliding boards 1341, causing the sliding boards 1341 to covered on the rear ends of the metal blades 133. When the back board 13 is coupled to the body 12, the sliding boards 1341 is forced upwards from the rear ends of the metal blades 133 by the power contact metal plates 1231, enabling the rear ends of the metal blades 133 to contact the power contact metal plates 1231. The body 12 further comprises a second spring retainer 125 terminating in a hooked portion 1251. The back board 13 comprises a raised retaining portion 1331. When the back board 13 is inserted into the sliding tracks 124, the raised retaining portion 1331 of the back board 13 is forced into engagement with the hooked portion 1251 of the spring retainer 125, and therefore the back board 13 is firmly secured to the body 12. The back board further comprises a press rod 131. When the press rod 131 is depressed, the hooked portion 1251 is disengaged from the raised retaining portion 1331, enabling the back board 13 to be removed from the body 12.

Referring to FIG. 4-B. the metal blades and grounding prong of the back board 13 may be variously shaped to fit different electric sockets.

Referring to FIG. 4-C, the back board 13 may be provided with a plug 136 instead of the aforesaid grounding prong 132 and metal blades 133. By means of the plug 136, the electric socket adapter can be connected to the socket for cigarette lighter of a car to obtain battery power supply from thc car.

Referring to FIG. 4-D, tile back board 13 may be provided having a first wire holder 132' and two second wire holders 133' to hold a green (grounding) wire 1323' and two power wires (one black wire and one white wire) 1313'. When the wires 1323';1313' are respectively inserted into wire holes 1311';1321' on the wire holders 132';133', binding screws 1322';1312' are respectively fastened to the wire holders 132';133' to fix the wires 1323';1313' in place.

FIGS. 4-E and 4-F show still another alternate form of the back board 13. According to this alternate form, the back board 13 comprises a raised retaining portion 1331 for engagement with the hooked portion 1251 of tile springy projecting strip 125 of the aforesaid body 12, a press rod 131 controlled to disengage the raised retaining portion 1331 from the hooked portion 1251 of the springy projecting strip 125, a grounding prong 132, two metal blades 133, two electrically insulative shields 13411 respectively raised from the back side wall thereof around the rear ends of the metal blades 133 and defining a respective downwardly extended receiving hole 1312, two metal terminals 1311 respectively mounted in the receiving holes 1312 within the electrically insulative shields 13411. When the back board 13 is coupled to the body 12, L-shape power contact metal plates 1232 of the body 12 are respectively inserted into the receiving holes 1312 into contact with the metal terminals 1311, enabling the metal blades 133 to be respectively electrically connected to the second metal racks 3 (see also FIG. 1).

FIG. 4-G shows still another alternate form of the back board 13. According to this alternate form, tile back board 13 comprises two electrically insulative shields 13411 respectively raised from the back side wall thereof around the rear ends of the metal blades 133 and defining a respective downwardly extended receiving hole for receiving respective L-shaped power contact metal plates 1233 of tile body 12. The L-shaped power contact metal plates 1233 of the body 12 each have a convex portion 12331. When the L-shaped power contact metal plates 1233 of the body 12 are respectively inserted into the receiving holes within the electrically insulative shields 13411, the convex portions 12331 of the L-shaped power contact metal plates 1233 of the body 12 are firmly retained in contact with the real-ends of the metal blades 133 of the back board 13.

FIG. 5 shows still another alternate form of the present invention. According to this alternate form, a first metal rack 2' and two second metal racks 3' are respectively mounted in the body 12', and a face panel 11" is covered on the body 12' a tile front side and fixedly secured thereto by a ultrasonic sealing apparatus, and a back board 13' is detachably coupled to the body 12' and secured in place by a spring retainer 125. The face panel 11" can be either one shown in FIG. 5-A.

FIGS. 6 and 6-A show still another alternate form of the present invention. According to this alternate form, the face panel 11"' comprises two hooks 1112 bilaterally raised from the back side thereof at the top and two retaining notches 1113 bilaterally disposed at the bottom, the body 12" comprises two hook holes 128 and two retaining portions 1281 for engagement with the hooks 1112 and retaining notches 1113 of the face panel 11"'.

Although exemplary embodiments of the invention have been shown and described, many changes, modifications and substitutions may be made by one having ordinary skill in the art without necessarily departing from the spirit and scope of the invention.

What the invention claimed is:

1. A safety electric socket adapter comprising:

a body, said body comprising an opened front side, an opened rear side, an elongated middle chamber, two side chambers at two opposite sides of said elongated middle chamber, two front sliding tracks longitudinally bilaterally provided at said opened front side, two rear sliding tracks longitudinally bilaterally provided at said opened rear side;

a first metal rack made by stamping a metal sheet into shape and mounted in the elongated middle chamber of said body, said first metal rack having a plurality of clamping mouths for receiving the grounding prong of one of a set of electric plugs;

two second metal racks respectively made by stamping a metal sheet into shape and mounted in the side chambers of said body, said second metal racks each having a plurality of clamping mouths for receiving the metal blades of one of a set of electric plugs;

a face panel covered on the opened front side of said body, said face panel comprising two longitudinal side flanges respectively inserted into the front sliding tracks of said body, a plurality of grounding plug holes and power plug holes for receiving the grounding prong and metal blades of one of a set of electric plugs, spring means provided at a back side wall thereof, sliding gate means moved in respectively sliding ways at the back side wall and forced by said spring means to close said power plug holes, said gate means being moved away from said power plug holes upon the insertion of the power contact metal blades of an electric plug;

a spring retainer mounted in said body to secure said back board in place, said spring retainer comprising a hooked portion at one end;

a first metal contact plate mounted in said body and connected to said first metal rack;

two second metal contact plates mounted in said body and respectively connected to said second metal racks; and a back board covered on the opened rear side of said body and secured in place by said spring retainer, said back board comprising two longitudinal side flanges respectively inserted into the rear sliding tracks of said body, a raised retaining portion which is forced into engagement with the hooked portion of said spring retainer when the side flanges of said back board are inserted into the rear sliding tracks of said body, a press rod controlled to disengage said raised retaining portion from the hooked portion of said spring retainer, a grounding prong and two power contact metal blades for inserting into the grounding plug hole and power plug holes of an electric socket, the grounding prong and power contact metal blades of said back board being retained in contact with said first metal contact plate and said second metal contact plates when said back board is coupled to said body, said power contact metal blades each having a front end protruded from a front side wall of said back board and a rear end protruded from a rear side wall of said back board for connection to said second metal racks, two spring-supported gate means forced by respective spring elements to cover the rear ends of said power contact metal blades, said spring-supported gate means of said back board being forced away from the rear ends of said power contact metal blades by said second metal contact plates when said back board is coupled to said body, enabling the rear ends of said power contact metal blades to be forced into contact with said second metal contact plates.

2. A safety electric socket adapter comprising:

a body, said body comprising an opened front side, an opened rear side, an elongated middle chamber, two side chambers at two opposite sides of said elongated middle chamber, two front sliding tracks longitudinally bilaterally provided at said opened front side, two rear sliding tracks longitudinally bilaterally provided at said opened rear side;

a first metal rack made by stamping a metal sheet into shape and mounted in the elongated middle chamber of said body, said first metal rack having a plurality of clamping mouths for receiving the grounding prong of one of a set of electric plugs;

two second metal racks respectively made by stamping a metal sheet into shape and mounted in the side chambers of said body, said second metal racks each having a plurality of clamping mouths for receiving the metal blades of one of a set of electric plugs;

a face panel covered on the opened front side of said body, said face panel comprising two longitudinal side flanges respectively inserted into the front sliding tracks of said body, a plurality of grounding plug holes and power plug holes for receiving the grounding prong and metal blades of one of a set of electric plugs, spring means provided at a back side wall thereof, sliding gate means moved in respectively sliding ways at the back side wall and forced by said spring means to close said power plug holes, said gate means being moved away from said power plug holes upon the insertion of the power contact metal blades of an electric plug;

a spring retainer mounted in said body to secure said back board in place, said spring retainer comprising a hooked portion at one end;

a first metal contact plate mounted in said body and connected to said first metal rack;

two second metal contact plates mounted in said body and respectively connected to said second metal racks; and a back board covered on the opened rear side of said body and secured in place by said spring retainer, said back board comprising two longitudinal side flanges respectively inserted into the rear sliding tracks of said body, a raised retaining portion which is forced into engagement with the hooked portion of said spring retainer when the side flanges of said back board are inserted into the rear sliding tracks of said body, a press rod controlled to disengage said raised retaining portion from the hooked portion of said spring retainer, a plurality of wire holders, and a plurality of binding screws respectively fastened to said wire holders to secure a green wire, a blade wire and a white wire to said wire holders and respectively retained in contact with said first metal rack and said second metal racks.

3. A safety electric socket adapter comprising:

a body, said body comprising an opened front side, an opened rear side, an elongated middle chamber, two side chambers at two opposite sides of said elongated middle chamber, two front sliding tracks longitudinally bilaterally provided at said opened front side, two rear sliding tracks longitudinally bilaterally provided at said opened rear side;

a first metal rack made by stamping a metal sheet into shape and mounted in the elongated middle chamber of said body, said first metal rack having a plurality of clamping mouths for receiving the grounding prong of one of a set of electric plugs;

two second metal racks respectively made by stamping a metal sheet into shape and mounted in the side chambers of said body, said second metal racks each having a plurality of clamping mouths for receiving the metal blades of one of a set of electric plugs;

a face panel covered on the opened front side of said body, said face panel comprising two longitudinal side flanges respectively inserted into the front sliding tracks of said body, a plurality of grounding plug holes and power plug holes for receiving the grounding prong and metal blades of one of a set of electric plugs, spring means provided at a back side wall thereof, sliding gate means moved in respectively sliding ways at the back side wall and forced by said spring means to close said power plug holes, said gate means being moved away from said power plug holes upon the insertion of the power contact metal blades of an electric plug;

a spring retainer mounted in said body to secure said back board in place, said spring retainer comprising a hooked portion at one end;

a first metal contact plate mounted in said body and connected to said first metal rack;

two second metal contact plates mounted in said body and respectively connected to said second metal racks; and a back board covered on the opened rear side of said body and secured in place by said spring retainer, said back board comprising two longitudinal side flanges respectively inserted into the rear sliding tracks of said body, a raised retaining portion which is forced into engagement with the hooked portion of said spring retainer when the side flanges of said back board are inserted into the rear sliding tracks of said body, and a press rod controlled to disengage said raised retaining portion from the hooked portion of said spring retainer, a grounding prong and two power contact metal blades for inserting into the grounding plug hole and power plug holes of an electric socket, the grounding prong and power contact metal blades of said back board being retained in contact with said first metal contact plate and said second metal contact plates when said back board is coupled to said body, said power contact metal blades each having a front end protruded from a front side wall of said back board and a rear end protruded from a rear side wall of said back board for connection to said second metal racks, two electrically insulative shields respectively raised from the rear side walls around the rear ends of said power contact metal blades, said electrically insulative shields each defining a downwardly extended receiving hole into which said second metal contact plates are inserted, and two metal terminals respectively mounted in the receiving holes within said electrically insulative shields and retained in contact with the rear ends of said power contact metal blades, said metal terminals receiving said second metal contact plates respectively when said back board is coupled to said body.

4. A safety electric socket adapter comprising:

a body, said body comprising an opened front side, an opened rear side, an elongated middle chamber, two side chambers at two opposite sides of said elongated middle chamber, two front sliding tracks longitudinally bilaterally provided at said opened front side, two rear sliding tracks longitudinally bilaterally provided at said opened rear side;

a first metal rack made by stamping a metal sheet into shape and mounted in the elongated middle chamber of said body, said first metal rack having a plurality of clamping mouths for receiving the grounding prong of one of a set of electric plugs;

two second metal racks respectively made by stamping a metal sheet into shape and mounted in the side chambers of said body, said second metal racks each having a plurality of clamping mouths for receiving the metal blades of one of a set of electric plugs;

a face panel covered on the opened front side of said body, said face panel comprising two longitudinal side flanges respectively inserted into the front sliding tracks of said body, a plurality of grounding plug holes and power plug holes for receiving the grounding prong and metal blades of one of a set of electric plugs, spring means provided at a back side wall thereof, sliding gate means moved in respectively sliding ways at the back side wall and forced by said spring means to close said power plug holes, said gate means being moved away from said power plug holes upon the insertion of the power contact metal blades of an electric plug;

a spring retainer mounted in said body to secure said back board in place, said spring retainer comprising a hooked portion at one end;

a first metal contact plate mounted in said body and connected to said first metal rack;

two second metal contact plates mounted in said body and respectively connected to said second metal racks; and a back board covered on the opened rear side of said body and secured in place by said spring retainer, said back board comprising two longitudinal side flanges respectively inserted into the rear sliding tracks of said body, a raised retaining portion which is forced into engagement with the hooked portion of said spring retainer when the side flanges of said back board are inserted into the rear sliding tracks of said body, and a press rod controlled to disengage said raised retaining portion from the hooked portion of said spring retainer, a grounding prong and two power contact metal blades for inserting into the grounding plug hole and power plug holes of an electric socket, the grounding prong and power contact metal blades of said back board being retained in contact with said first metal contact plate and said second metal contact plates when said back board is coupled to said body, said power contact metal blades each having a front end protruded from a front side wall of said back board and a rear end protruded from a rear side wall of said back board for connection to said second metal racks, two electrically insulative shields respectively raised from the rear side walls around the rear ends of said power contact metal blades, said electrically insulative shields each defining a downwardly extended receiving hole into which said second metal contact plates are inserted and forced into contact with the rear ends of said power contact metal blades when said back board is coupled to said body.

5. The safety electric socket adapter of claim 4 wherein said second metal contact plates each have a L-shaped shape, and a convex portion at one end which is retained in the downwardly extended receiving holes within said electrically insulative shields in contact with the rear ends of said power contact made blades when said back board is coupled to said body.

6. A safety electric socket adapter comprising:

a plastic body, said body comprising an opened front side, an opened rear side, an elongated middle chamber, two side chambers at two opposite sides of said elongated middle chamber, and two rear sliding tracks longitudinally bilaterally provided at said opened rear side;

a first metal rack made by stamping a metal sheet into shape and mounted in the elongated middle chamber of said body, said first metal rack having a plurality of clamping mouths for receiving the grounding prong of one of a set of electric plugs;

two second metal racks respectively made by stamping a metal sheet into shape and mounted in the side chambers of said body, said second metal racks each having a plurality of clamping mouths for receiving the metal blades of one of a set of electric plugs;

a plastic face panel covered on the opened front side of said plastic body and heat-sealed thereto, said face panel comprising a plurality of grounding plug holes and power plug holes for receiving the grounding prong and metal blades of one of a set of electric plugs, spring means provided at a back side wall thereof, sliding gate means moved in respectively sliding ways at the back side wall and forced by said spring means to close said power plug holes, said gate means being moved away from said power plug holes upon the insertion of the power contact metal blades of an electric plug;

a spring retainer mounted in said body to secure said back board in place, said spring retainer comprising a hooked portion at one end;

a first metal contact plate mounted in said body and connected to said first metal rack;

two second metal contact plates mounted in said body and respectively connected to said second metal racks; and a back board covered on the opened rear side of said body and secured in place by said spring retainer, said back board comprising two longitudinal side flanges respectively inserted into the rear sliding tracks of said body, a raised retaining portion which is forced into engagement with the hooked portion of said spring retainer when the side flanges of said back board are inserted into the rear sliding tracks of said body, a press rod controlled to disengage said raised retaining portion from the hooked portion of said spring retainer, a grounding prong and two power contact metal blades for inserting into the grounding plug hole and power plug holes of an electric socket, the grounding prong and power contact metal blades of said back board being retained in contact with said first metal contact plate and said second metal contact plates when said back board is coupled to said body, said power contact metal blades each having a front end protruded from a front side wall of said back board and a rear end protruded from a rear side wall of said back board for connection to said second metal racks, two spring-supported gate means forced by respective spring elements to cover the rear ends of said power contact metal blades, said spring-supported gate means of said back board being forced away from the rear ends of said power contact metal blades by said second metal contact plates when said back board is coupled to said body, enabling the rear ends of said power contact metal blades to be forced into contact with said second metal contact plates.

* * * * *